US010544491B2

(12) United States Patent
Toschi

(10) Patent No.: US 10,544,491 B2
(45) Date of Patent: Jan. 28, 2020

(54) METHOD FOR MINIMIZING THE GLOBAL PRODUCTION COST OF LONG METAL PRODUCTS AND PRODUCTION PLANT OPERATING ACCORDING TO SUCH METHOD

(71) Applicant: PRIMETALS TECHNOLOGIES ITALY S.R.L., Marnate (IT)

(72) Inventor: Francesco Toschi, Legnano (IT)

(73) Assignee: PRIMETALS TECHNOLOGIES ITALY S.R.L. (IT)

( * ) Notice: Subject to any disclaimer, the term of this patent is extended or adjusted under 35 U.S.C. 154(b) by 291 days.

(21) Appl. No.: 15/523,540

(22) PCT Filed: Oct. 16, 2015

(86) PCT No.: PCT/EP2015/073967
§ 371 (c)(1),
(2) Date: May 1, 2017

(87) PCT Pub. No.: WO2016/071093
PCT Pub. Date: May 12, 2016

(65) Prior Publication Data

US 2017/0298491 A1 Oct. 19, 2017

(30) Foreign Application Priority Data

Nov. 4, 2014 (EP) ..... 14425141

(51) Int. Cl.
*B21B 1/46* (2006.01)
*C22C 47/20* (2006.01)
(Continued)

(52) U.S. Cl.
CPC ..... *C22C 47/20* (2013.01); *B21B 1/46* (2013.01); *C21D 7/13* (2013.01); *C22C 1/02* (2013.01);
(Continued)

(58) Field of Classification Search
CPC . B21B 2261/20; B21B 2261/21; B21B 37/74; B21B 45/004; B21B 38/006;
(Continued)

(56) References Cited

U.S. PATENT DOCUMENTS 5,461,894 A 10/1995 Sörgel ..... 72/8
8,479,550 B2 7/2013 Eckerstorfer ..... 72/202
(Continued)

FOREIGN PATENT DOCUMENTS

CN 1272887 A 11/2000
CN 101304819 A 11/2008
(Continued)

OTHER PUBLICATIONS

Kobashi, JP-03081012 Translation (Year: 1991).*
(Continued)

*Primary Examiner* — Adam J Eiseman
*Assistant Examiner* — Bobby Yeonjin Kim
(74) *Attorney, Agent, or Firm* — Ostrolenk Faber LLP

(57) ABSTRACT

A method for producing long metal products includes the steps of receiving long intermediate products traveling on respective continuous casting lines, to an exit area, and subsequently introducing products from the exit area into a production plant having known layout parameters; the production plant has a rolling mill for rolling the products; interconnected production lines between the exit area of the casting machine and the rolling mill, the production lines define production paths or routes; and a first and a second heating devices. The method associates a mathematical model to the production plant for dynamically calculating a reference value, or Global Heating Cost Index, correlated to heating devices; automatically determining for the intermediate products the production path or route that minimizes the reference value, or Global Heating Cost Index; and
(Continued)

eventually automatically routing each of the products along the determined production path which minimizes the reference value, or Global Heating Cost Index.

15 Claims, 3 Drawing Sheets

(51) Int. Cl.

| | |
|---|---|
| ***C21D 7/13*** | (2006.01) |
| ***C22C 1/02*** | (2006.01) |
| *B21B 1/00* | (2006.01) |
| *C22C 33/00* | (2006.01) |
| *C22C 47/00* | (2006.01) |

(52) U.S. Cl.
CPC ..... *B21B 1/00* (2013.01); *C22C 33/00* (2013.01); *C22C 47/00* (2013.01)

(58) Field of Classification Search
CPC ..... B21B 1/46; B21B 1/466; B21B 13/22; B22D 11/1206; G05B 2219/49051; G05B 17/00
See application file for complete search history.

(56) References Cited

U.S. PATENT DOCUMENTS

| | | | | |
|---|---|---|---|---|
| 9,108,234 | B2 | 8/2015 | Eckerstorfer et al. | |
| 2002/0095764 | A1* | 7/2002 | Bald | B21B 1/466 29/527.7 |
| 2005/0039320 | A1* | 2/2005 | Thomanek | B21B 1/26 29/527.7 |
| 2007/0151635 | A1* | 7/2007 | Sano | B21B 37/44 148/508 |
| 2012/0078407 | A1* | 3/2012 | Hama | B21B 13/22 700/104 |
| 2013/0112365 | A1* | 5/2013 | Colombo | B22D 11/14 164/476 |
| 2014/0096578 | A1* | 4/2014 | Eckerstorfer | B21B 1/46 72/40 |
| 2017/0106437 | A1* | 4/2017 | Colombo | B21B 39/004 |

FOREIGN PATENT DOCUMENTS

| | | | | | |
|---|---|---|---|---|---|
| DE | 197 44 815 | C1 | | 3/1999 | |
| DE | 10 2011 077 322 | A1 | | 12/2012 | |
| JP | S 51-101769 | A | | 9/1976 | |
| JP | S 57-121809 | A | | 7/1982 | |
| JP | S57-187102 | A | | 11/1982 | |
| JP | 03081012 | A | * | 4/1991 | B21B 1/466 |
| JP | 2006-318228 | A | | 11/2006 | |
| JP | 2006318228 | A | * | 11/2006 | B21B 1/466 |
| RU | 2078626 | C1 | | 5/1997 | |
| SU | 1444003 | A1 | | 12/1988 | |
| WO | WO 2012/159955 | A1 | | 11/2012 | |

OTHER PUBLICATIONS

Kurokawa, JP-2006318228 Translation (Year: 2006).*
Office Action dated Jul. 23, 2018 issued in corresponding Japanese Patent Application No. 2017-542282 with English Translation.
International Search Report dated Feb. 18, 2016 in corresponding PCT International Application No. PCT/EP2015/073967.
Written Opinion dated Feb. 18, 2016 in corresponding PCT International Application No. PCT/EP2015/073967.
Extended European Search Report dated May 19, 2015 in corresponding European Patent Application No. 14425141.0.
Chinese Office Action, dated May 18, 2018, issued in corresponding Chinese Patent Application No. 201580060148.7. Including English translation. Total 21 pages.
Office Action and Search Report dated Mar. 19, 2019 issued in corresponding Russian Application No. 2017115469 with English translation.
Office Action dated May 20, 2019 issued in corresponding Chinese Application No. 201580060148.7 with English translation.

* cited by examiner

METHOD FOR MINIMIZING THE GLOBAL PRODUCTION COST OF LONG METAL PRODUCTS AND PRODUCTION PLANT OPERATING ACCORDING TO SUCH METHOD

CROSS-REFERENCE TO RELATED APPLICATIONS

The present application is a 35 U.S.C. §§ 371 national phase conversion of PCT/EP2015/073967, filed Oct. 16, 2015, which claims priority of European Patent Application No. 14425141.0, filed Nov. 4, 2014, the contents of which are incorporated by reference herein. The PCT International Application was published in the English language.

TECHNICAL FIELD

The present invention relates to a method and a system for rationalizing the production of long metal products such as bars, rods, wire and the like, and particularly to a method and a system for making the production more energy efficient.

TECHNICAL BACKGROUND

The production of long metal products is generally realized in a plant by a succession of steps. Normally, in a first step, metallic scrap is provided as feeding material to a furnace which heats the scraps up to reach the liquid status. Afterwards, continuous casting equipment is used to cool and solidify the liquid metal and to form a suitably sized strand. Such a strand may then be cut to produce a suitably sized intermediate long product, typically a billet or a bloom, to create feeding stock for a rolling mill. Normally, such feeding stock is then cooled down in cooling beds. Thereafter, a rolling mill is used to transform the feeding stock, otherwise called billet or bloom depending on dimensions, to a final long product, for instance rebars or rods or coils, available in different sizes which can be used in a mechanical or construction industry. To obtain this result, the feeding stock is pre-heated to a temperature which is suitable for entering the rolling mill so as to be rolled by rolling equipment consisting of multiple stands. By rolling through these multiple stands, the feeding stock is reduced to the desired cross section and shape. The long product resulting from the former rolling process is normally cut when it is still in a hot condition; then cooled down in a cooling bed; and finally cut at a commercial length and packed to be ready for delivery to the customer.

A production plant could be ideally arranged in a way such that a direct, continuous link is established between a casting station and the rolling mill which is fed by the product of the casting procedure. In other words, the strand of intermediate product leaving the casting station would be rolled by the rolling mill continuously along one casting line. In a plant operating according to such a mode, also known as an endless mode, the continuous strand that is cast from the casting station along a corresponding casting line would be fed to the rolling mill. However, solely producing product according to such a direct charge modality does not offer the possibility of managing production interruption. Moreover, as a consequence of the normally different production rates between continuous casting apparatus and rolling mill apparatus, the production according to an exclusively endless mode is actually not preferred, or not even possible because only a part of the meltshop production would-be directly transformed into finished product.

In fact, due to the abovementioned different production rates of continuous casting apparatus and rolling mill apparatus, a plant for manufacturing long metal products is still normally arranged so that the rolling mill is fed with preliminarily cut intermediate products. Moreover, there is a desire to allow rolling of supplemental long intermediate products which may be laterally inserted into the production line directly connected to the rolling mill, for instance, by sourcing them from buffer stations which are not necessarily aligned with the rolling mill. Consequently, such feeding stock still needs to be pre-heated to a temperature which is suitable for entering the rolling mill and for being appropriately rolled therethrough.

Whatever production mode is used, in the end, to this day a huge amount of energy is commonly lost, in hot deformation processes in general and in particular in rolling by a rolling mill. This is mainly due to the fact that, during the full production route from scrap to finished products (bars, coils, rods), intermediate steps are still operationally required wherein long intermediate products, such as billets or blooms, are generated that must be cooled down to room temperature and stored, for either shorter or longer times, before the rolling phase can be actually carried out on them, according to the given overall production schedule.

Reheating from room temperature to a proper hot deformation process temperature consumes between 250 and 370 kWh/t, depending on specific process route and steel grades.

Current technologies of reheating furnaces do not allow to switch between an on and an off state of the gas fired furnace depending on actual heating requirements. Generally, only a power reduction option is given.

Due to current technologies, state of the art heating devices employed in plants for manufacturing of long metal products consume energy and generate CO2 emissions even when not required or justified from a production point of view. This amount of energy is commonly obtained from combustion of fossil fuel (heavy oil, natural gas) and thus brings about an intrinsic additional cost for companies due to the production of CO2. Given that a medium size steel production plant (1 million t of rolled product) produces around 70.000 t of CO2 per year, it is immediately clear how costs attributable to carbon footprint emissions represent a considerable burden which needs to be taken into account, on top of the costs linked to production.

In the so-called hot charging process of the prior art, billets or blooms arrive randomly, i.e. not according to a predefined energy-saving production pattern, from the continuous casting machine exit area, and thereafter for instance from a so-called hot buffer, whenever there is space available on the rolling mill. Such billets or blooms must at any rate be reheated to a temperature suitable for rolling in a dedicated fuel heating device.

As already explained, the fuel heating device can also be loaded with billets or blooms coming from a longer term storage which is effectively used as a cold buffer. In such case the fuel heating device must be continuously heated up to guarantee at any time the appropriate billets temperature for rolling operations.

None of the existing plants for production of long metal products by continuous casting and rolling processes adopts a holistic approach to reducing production costs and none of them is specifically designed to effectively take into account both throughput and energy optimization.

Analogously, none of the existing plants for production of long metal products by continuous casting and rolling processes aims at improving the eco-efficiency of manufacturing operations by adopting structured environmental management work-flows and systems based on the implementation of case-tailored but scientifically repeatable eco-efficiency strategies.

Thus, a need exists in the prior art for a method, and a corresponding system, for the production of long rolled products from casting lines which reduces the environmental impact of manufacturing operations while at the same time optimizing throughput and energy consumption, in line with the goal of sustainable development and cleaner, efficient production.

SUMMARY OF THE INVENTION

Accordingly, a major objective of the present invention is to provide a method, and a corresponding plant, for production of long metal products which allows:

- to exploit at the best, in terms of output, the potentiality of a multi-mode production wherein direct charging to a rolling mill via a passage through a first heating device and/or hot-charging from a hot-buffer station by way of an intermediate passage through a second heating device and/or cold-charging from a cold-buffer station, also by way of an intermediate passage through a second heating device can be executed minimizing the global transformation cost;

and, at the same time, offers the option

- to improve eco-efficiency performance by automatically rationalizing energy consumption in function of the energy cost.

The plant according to the present invention operates in a way that it can swiftly adapt to different production requirements and circumstances, dependent on actual production needs, taking into account energy availability and cost, for instance in function of times of the day. In this way, production can be adjusted to the current, actual requests, for instance according to commission orders, and to current energy availability and consumption costs.

The present invention allows productivity increase in an automatic and rationalized fashion. In particular, the present invention represents the optimal way to transform a long intermediate product, or semiproduct, into a finished product minimizing the global production cost.

A companion objective of the present invention is to allow to reach the above flexibility while at the same time keeping the overall plant energy-wise efficiently operative in a programmed, repeatable and rational way.

In this respect, the movements and/or routing of billets along the production line which is directly conveying elongate intermediate products to a rolling mill or at any rate with which the rolling mill is aligned; as well as the movements and/or routing of billets from the different buffers, or buffer stations, to be introduced into the line going to the rolling mill are automatically controlled in a way that the energy allocation to the different phases or steps of the work-flow and the different sections of the production plant is optimized.

By adopting the above measures, the present invention ensures that the temperature of the intermediate long products, such as billets, is kept throughout the several possible production work-flow paths optimally suitable to minimize energy consumption.

The choice between several possible production work-flow paths, or routes, is advantageously automatically operated based on efficiency criteria, relying on systematic collection and processing of actual data along the production plant and on set targets and constraints. The most convenient path, then, is iteratively determined for each intermediate long product in the production lines, in a way that the transformation into the finished product happens with a minimum global production cost.

Less power is thus needed to re-heat the intermediate long products to a temperature that is suitable to subsequent hot rolling, in compliance with more and more relevant energy saving measures and ecological requirements.

The present invention achieves these and other objectives and advantages by a method disclosed herein and by advantageous embodiments.

BRIEF DESCRIPTION OF THE DRAWINGS

Other objectives, features and advantages of the present invention will be now described in greater detail with reference to specific embodiments represented in the attached drawings, wherein.

DESCRIPTION OF EMBODIMENTS

Figure 1:
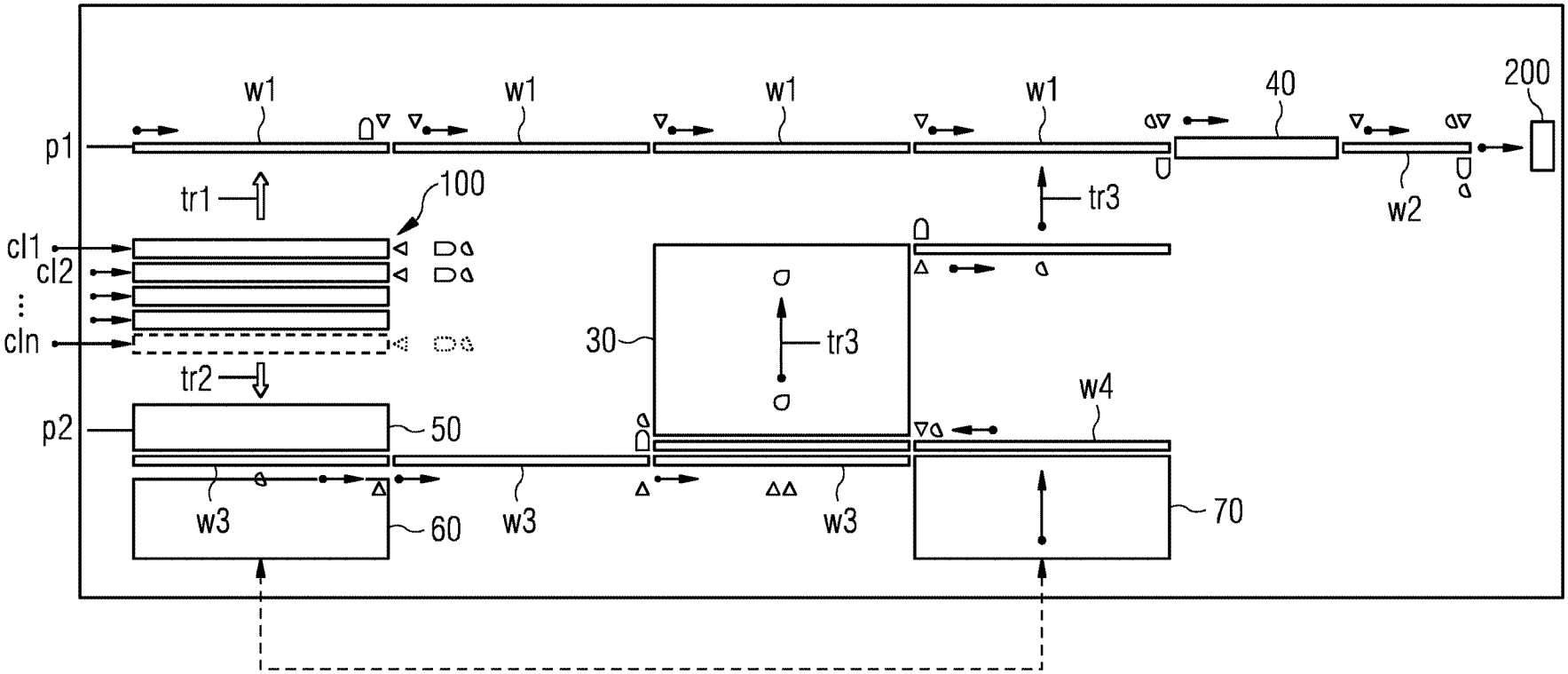
FIG. 1 is a schematic, general view of the layout a production plant functioning according to an embodiment of the method according to the present invention, wherein the plant components and the possible production routes or paths for long intermediate products resulting from continuous casting towards the rolling mill station are highlighted.
Figure 2:
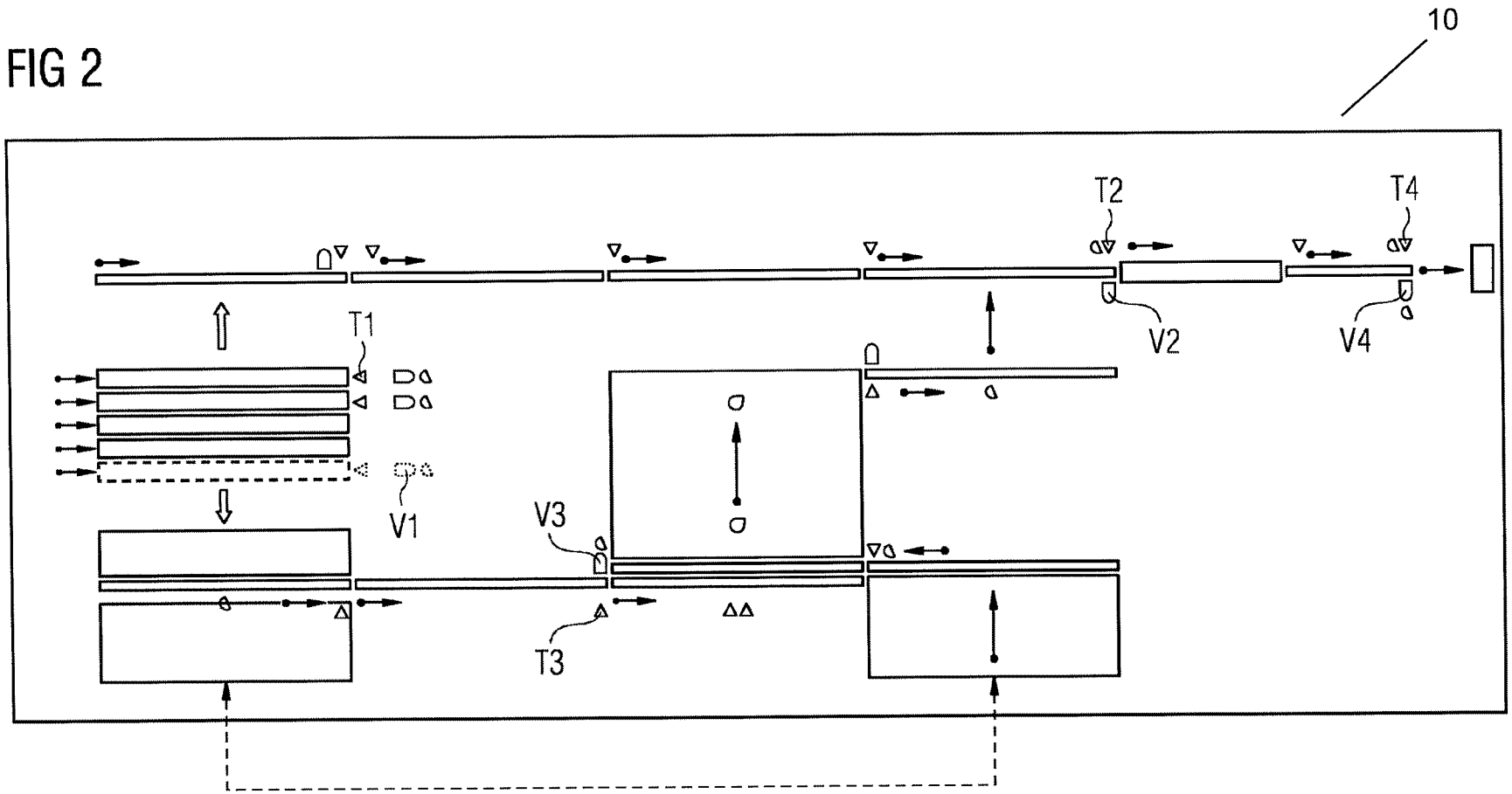
FIG. 2 is a schematic, general view of the production plant of FIG. 1, wherein the detection of actual temperature at four stations along production routes or paths and the detection of the presence and/or position of long intermediate products resulting from continuous casting in their progression towards the rolling mill station are emphasized.

In the figures, like reference numerals depict like elements.

A method for producing long metal products such as bars, rods, wire or the like according to the present invention is illustrated with reference to a schematic representation in FIG. 1 of a corresponding production plant 10 adapted to operate in compliance with the production method.

It will be thus made evident what plant equipment and devices contribute to executing the steps of the method according to the present invention. The dynamic layout model on which the method according to the present invention is based, as well as the parameters that play a role in the implementation of such method, will also be clarified making reference to a schematic representation of a compatible production plant, such as the one of FIG. 1.

A plant 10 for the production of long metal products such as bars, rods, wire or the like and configured to operate in compliance with the production method of the present invention preferably comprises a continuous casting machine exit area 100 (also denoted with acronym CCM) and a rolling mill area comprising at least one rolling stand 200.

Moreover, such a plant preferably comprises a multiplicity of interconnected production lines p1, p2 comprised between the exit area 100 of the continuous casting machine and the rolling mill 200. These production lines p1, p2 define a multiplicity of production paths or routes, such as route 1, route 2, route 3.

Long intermediate products produced by an upstream continuous casting station along at least one casting line converge towards a continuous casting machine exit area 100. More in particular and preferably, the continuous casting station forms a multiplicity of strands which travel along respective continuous casting lines; out of such strands, long intermediate products are created which, along the respective casting lines, are carried to and received at the continuous casting machine exit area 100.

In the embodiments of FIG. 1, a multiplicity of casting lines cl1, cl2 . . . cln, along which respective continuous strands and/or long intermediate products travel, is exemplified.

For simplicity, in the case of the specific embodiment represented in FIG. 1 the casting lines cl1, cl2, . . . , cln are represented all offset from the production lines p1, p2 and the relative conveyor systems, such as roller conveyors, leading through the possible production paths or routes. However, it is also possible that at least one of such casting lines is positioned in line with a conveyor system on which the long intermediate products are moved, for instance with conveyors w1 and w2 on production line p1 directly leading to the rolling mill area 200. Conveyors w1 and w2 are part of a production line p1 of the production plant.

Conveyors w3, w4 are part of a further production line p2 of the production plant. Conveyors w1, w2 are represented offset from conveyors w3, w4 and are positioned on opposite sides with respect to exit area 100.

Moreover, a plant adapted to function according to the method of the present invention may preferably comprise transfer means tr1, tr2 and tr3 for transferring long intermediate products, between

- a respective casting line cl1, cl2, . . . , cln, at the station where the intermediate products have reached said continuous casting machine exit area 100; and
- a portion of the conveyors on a production line p1, such as conveyors w1, like in the case of first transfer means tr1;

or between

- a respective casting line cl1, cl2, . . . , cln, at the station where the intermediate products have reached said continuous casting machine exit area 100; and
- a portion of the conveyors on a production line p2, such as conveyors w3, like in the case of second transfer means tr2;

or between

- opposed conveyor portions on opposed production lines p1 and p2, such as between sections of conveyors w4 or w3 and w1, like in the case of third transfer means tr3.

The production line p1 along which the long intermediate products are directly conveyed to the rolling mill 200 via a passage through a first heating device 40 can be connected to the continuous casting machine exit area 100 via first transfer means tr1 apt to transfer the long intermediate products from the continuous casting machine exit area 100 to conveyors w1 aligned with the rolling mill 200. Otherwise, one portion of the continuous casting machine exit area 100 can itself be aligned with such conveyors w1 which are aligned, in their turn, with the rolling mill 200, to deliver the long intermediate products directly to the rolling mill 200 on the same production line p1.

A plant for the production of long metal products such as bars, rods or the like and configured to operate in compliance with the production method of the present invention preferably also comprises and manages a multiplicity of heating devices. In the specific case of FIG. 1, the plant incorporates a first heating device 40, preferably an induction heating device; and a second heating device 30, preferably a fuel heating device. Heating device 30 is used for temperature equalization of intermediate products arriving from buffer stations. Heating device 40 is employed to bring the long intermediate products to a target temperature, such as Tc4, suitable for subsequent rolling in compliance with target technical requirements of the final rolled product.

With reference to FIG. 1, the conveyor portions w1 are positioned upstream of the induction heating device 40; whereas conveyor portions w2 are positioned downstream of the induction heating device 40. Similarly, the conveyor portions w3 are positioned upstream of the fuel heating device 30; whereas conveyor portions w4 are positioned downstream of the fuel heating device 30.

In addition to that, a plant configured to operate in compliance with the production method of the present invention preferably also comprises a hot buffer 50. Such a hot buffer 50 is preferably positioned in correspondence with, and in communication with, a conveyor section w3, on a production line p2.

Moreover, such a plant may also comprise a cold buffer 60, preferably also positioned in correspondence with, and in communication with, a conveyor section w3, as shown in FIG. 1.

Such a plant is also preferably provided with a cold charging table 70 or with an equivalent cold charging platform, advantageously positioned in correspondence with, and in communication with, a conveyor section w4, also on production line p2.

The cold charging table 70 may be also functionally and/or physically connected to cold buffer 60, so that the intermediate products reaching the latter can be advantageously transferred to the former in order to be ultimately cold stored, for instance in a given space allocated in a warehouse, until the system determines that the conditions are satisfied for these intermediate products to be reintroduced in the production work-flow.

With reference to the embodiment of FIG. 1, first transfer means tr1, for instance in the form of a transfer car, is used for transferring long intermediate products between

- the respective casting line, once such products have reached the continuous casting machine exit area 100; and
- a corresponding portion of the conveyor w1 so that the products can be directly delivered to the induction heating device 40 by way of subsequent conveyor portions w1 and, successively, to the rolling mill 200, by way of conveyor portions w2.

Consequently, the long intermediate products thus transferred are directly sent to a rolling mill 200 along a first production work-flow path 1, or route 1, according to a first rolling production mode.

With reference to the embodiment of FIG. 1, second transfer means tr2, for instance in the form of a transfer car, is used for transferring long intermediate products between

- the respective casting line, once such products have reached the continuous casting machine exit area 100; and
- either the hot buffer 50;
- or the cold buffer 60, following a preliminary passage through the hot buffer 50.

With reference to the embodiment of FIG. 1, third transfer means tr3, for instance in the form of a transfer car, is used for transferring long intermediate products exiting the fuel heating device 30 to a section of the conveyor w1 upstream of the induction heating device 40, so that they can proceed to the induction heating device 40 and, after a passage therethrough, eventually to the rolling mill 200.

Along a possible second production work-flow path 2 or route 2, according to a corresponding production mode different from the former direct rolling production mode, long intermediate products arrived at the continuous casting machine exit area 100 can be transferred by transfer means tr2 to the hot buffer 50. After that, such intermediate products can be brought by conveyor means w3 to fuel heating device 30 and, via transfer means tr3, they can be displaced on conveyor means w1 towards the induction furnace 40. Eventually, such intermediate products are forwarded via conveyor section w2 to the rolling mill 200.

Along a possible third production path 3 or route 3, according to yet another production mode different from the two previous production modes above, long intermediate products arrived at the continuous casting machine exit area 100 can be preliminarily transferred by transfer means tr2 to the hot buffer 50. After that, such intermediate products can be further transferred, by the same transfer means tr2 or by similar transfer means extending the displacement range thereof, to the cold buffer 60 where they are stocked. As explained above, a functional and/or physical connection (exemplified in FIG. 1 by a dotted line) may be established between the cold buffer 60 and a cold charging table 70, in a way that intermediate products cold stored for longer time in some warehouse or similar can later be reintroduced in the production work-flow, for instance advantageously via a passage though the fuel heating device 30 for temperature equalization and subsequent transfer via transfer means tr3 to conveyor w1 and induction heating device 40, analogously to the steps exposed in connection with the above possible second production work-flow path 2 or route 2.

Transfer means tr1, tr2 and tr3 are preferably bidirectional, or double acting, transfer means apt to lift, carry and transfer long intermediate products as above explained and readily repositionable either in correspondence of the continuous casting machine exit area 100, for tr1 and tr2; or at the exit from the fuel heating device 30, for tr3.

Transfer means tr1 to conveyor w1; and transfer means tr2 to the buffers 50, 60 have been indicated as distinct. However, it might be possible to incorporate the functionalities of transfer means tr1 and those of transfer means tr2 into one single transfer means, or transfer car, for instance by enhancing the speed of the bidirectional movement.

A production plant functioning according to the method of the present invention comprises an automation control system comprising special sensor means that cooperate with the above transfer means tr1, tr2, tr3.

Following the detection by sensor means of the presence of long intermediate products on a given casting line at a given station, temperature sensor means detect the temperature of the long intermediate products relative to the station, thus allowing real-time data updating for operating the production plant. Based on the temperature detected at a given station, a proportional signal is transmitted to the overall automation control system. As a result of the input received, the automation control system activates the above transfer means in compliance with the work-flow steps instructed by the method of the present invention.

The sensor means detecting the position or presence of the long intermediate products can be generic optical presence sensors, or more specifically can be hot metal detectors designed to detect the light emitted or the presence of hot infrared emitting bodies.

For instance, the temperature T1 of billets arrived from continuous casting on a casting line is preferably detected at the exit of the continuous casting machine exit area 100, when sensor means of said automation control system detect the presence thereof at station V1 which is substantially adjacent to the continuous casting machine exit area 100.

Moreover, the temperature T2 of billets traveling on conveyor sections w1 is preferably detected at the entry to the induction heating device 40, when sensor means detect the presence thereof at station V2 which is substantially adjacent to the entry to the induction heating device 40.

In addition to that, the temperature T3 of billets traveling on conveyor sections w3 is preferably detected at the entry to fuel heating device 30, when sensor means detect the presence thereof at station V3 which is substantially adjacent to the entry to the fuel heating device 30.

Eventually, the temperature T4 of billets traveling on conveyor sections w2 is preferably detected at the entry to rolling mill 200, when sensor means detect the presence thereof at station V4 which is substantially adjacent to the entry to the rolling mill 200.

Billets introduced to and traveling along a production plant functioning according to the method of the present invention can be further advantageously tagged and systematically monitored by additional sensor means, for instance while carried and transferred by transfer means tr1, tr2, tr3 and/or positioned on hot buffer 50 and/or stocked on cold buffer 60 and/or deposited on cold charging table 70.

The method according to the present invention is based on a mathematical model which is used to dynamically calculate a reference value, a so-called Global Heating Cost Index (otherwise denoted GHCI). The method according to the present invention manages the production work-flow and particularly the several heating sources available, such as the fuel heating device 30 and the induction heating device 40, in a way the Global Heating Cost Index is minimized. The Global Heating Cost Index is therefore correlated to the multiple heating devices of the production plant and particularly to their consumption.

The above mathematical model calculates the Global Heating Cost Index in an adaptive way, based on the actual, real-time conditions instantaneously detected by the sensor means. The ensuing simulation effectively models the functioning of a production plant whose layout parameters and device performances are taken into account by the mathematical model as explained below.

In the following, the mathematical model will be more specifically introduced, wherein the specific case of a long intermediate product in the form of a billet has been considered as an example.

The consumption of the fuel heating device 30 is calculated as:

$$SCGF=(240*DT+31000)/860+K1$$

Wherein:

SCGF is the specific consumption in kWh/t;

DT is the required temperature increment in ° C., wherein DT in this case is equivalent to the difference between T2 and T3;

K1 is a constant.

The heating rate in the fuel heating device 30 is calculated as:

$$HR1=K2+K3*(2067*BS^{exp0})$$

Wherein:

HR is the heating rate in ° C./min;

BS is the billet side dimension in mm;

K2 to k3 are constants;

Exp0 is a constant.

The dimensioning of the fuel heating device 30 is calculated as:

$$FL = K5 + K6 * \left((BS + \mathrm{GAP}) * \frac{PRODFG}{BW} * HT\right)$$

Wherein:
FL is the fuel heating device length in mm;
GAP is the distance between two billet inside the fuel heating device 30;
PRODFG is the production rate in t/h;
BW is the billet weight in t;
HT is the required heating time in h;
K5 to k6 are constants.

The consumption of the induction heating device 40 is calculated as:

$$SCIF = K7 + K8 * (0{,}3048 * DT)$$

Wherein:
SCIF is the specific consumption in kWh/t;
DT is the required temperature increment in ° C., wherein DT in this case is equivalent to the difference between T4 and T2;
K7 to k8 are constants.

The dimensioning of the induction heating device 40 is calculated as:

$$FL = K9 + K10 * (w1 + w2 * \mathrm{PROD} + w3 * DT + w4 * \mathrm{PROD} * DT - w6 * \mathrm{PROD}^2 - w7 * DT^2) * 1{,}3 + 3)$$

Wherein:
FL is the induction heating device length in m;
DT is the temperature increment required in ° C., wherein DT in this case is equivalent to the difference between T4 and T2;
PROD is the production rate in t/h;
w1 to w7 are constants.

The heating rate in the induction heating device 40 is calculated as:

$$HR2 = K11 + K12 * \left(DT * \frac{VIND}{FL}\right)$$

Wherein:
HR is the heating rate in ° C./s;
VIND is the induction heating device crossing speed in m/s;
DT is the required temperature increase in ° C., wherein DT in this case is equivalent to the difference between T4 and T2;
K11 to k12 are constants.

The amount of scale generated during the process steps is calculated as a function of temperature, billet surface in m2, and time of residence at such temperature.

The amount of CO2 generate in the fuel heating device is calculated as:

$$QCO2 = K15 + K16 * \frac{1{,}72 * SCGF}{POTC}$$

Wherein:
QCO2 is the quantity of CO2 produced for ton of finished product;
SCGF is the specific consumption of the fuel heating device in kWh/t;
POTC is the calorific power of the fuel in kcal/Nm3;
K15 to k16 are constants.

Ultimately, according to the mathematical model hereby introduced, the global heating index cost is calculated as:

$$GHIC = K17 + K18 * ((SCGF * PG) + (SCIF * PE) + (SSQ * FPP) + (QCO2 * CCO))$$

Wherein:
GHIC is the total heating cost in EURO/t;
SCFG is the specific consumption of the fuel heating device in kwh/t
PG is the fuel price;
SCIF is the specific consumption of the induction heating device in kwh/t;
PE is the electricity price;
SSQ is the specific scale quantity in % on the billet weight;
FPP is the finished rolled product price;
QCO2 is the CO2 quantity produced;
CCO is the CO2 cost in EURO/t;
K17 to k18 are constants.

In light of the above, it is clear how the mathematical model presented above takes into account a series of continually updated parameters which play a significant role in the production process and its economy, such as:
energy costs along the day; energy consumptions; CO2 production and cost; iron oxidation rate otherwise called scale production; meltshop production rate; rolling mill production rate; production schedule; storage capacity of intermediate products; storage capacity of the finished product.

The method according to the present invention relies on the above mathematical model for real time simulation of the production process and dynamic inference and calculation of a continually actualized Global Heating Cost Index.

The simulation and calculation of the global heating index cost is preferably carried out in calculation routines whose time-frame can be, for instance, of 100 ms. For establishing a direct link between the actual layout of the production implant and the mathematical model used for the simulation, advantageously a number of virtual sensor means can be defined in the mathematical model which are reflecting or are interconnected with the actual sensor means installed in the production plant.

Preferably, for each long intermediate product, such as typically a billet, the calculation of the respective associated Global Heating Cost Index is reiterated in successive calculation routines.

The sequence of steps implemented by the method according to the present invention manages to achieve that each long intermediate product follows a production path or route which actually minimizes the value obtained through the above calculation routines for the respective GHIC, or Global Heating Cost Index.

In determining the optimal production path or route for each of the long intermediate products to be processed, the algorithm underlying the method according to the present invention effectively manages the optimal use of the several heating sources available.

The algorithm underlying the method according to the present invention, in effectively routing each and all of the long intermediate products along a production path which minimizes the above defined Global Heating Cost Index, evidently takes into account, via the above introduced mathematical model, of the given layout of a production plant and of other setup data.

Such setup data can comprise the controlled speeds along the different conveyors and/or the different conveyor sections.

With reference to the mathematical model introduced, the setup data also preferably comprise the following quantities:

- DT2 which equals the pre-set maximal temperature increase in the induction heating device 40 relative to the given production plant layout adopted;
- t2 which equals the pre-set maximal time taken by the long intermediate product to cross the induction heating device 40;
- DT3 which equals the pre-set maximal temperature increase in the fuel heating device 30 relative to the given production plant layout adopted; and
- t3 which equals the pre-set maximal time to be spent by the long intermediate product inside the fuel heating device 30.

The present method also relies on an estimate of temperature losses or drops across the different stations of a production plant with a given layout. Such an estimate is based on known thermal models for evaluation of cooling processes. In this respect, the mathematical model above introduced takes into account the following temperature losses or drops relative to the characteristics of the long intermediate products which are being processed, to be derived or assumed from known thermal models for solid bodies:

- DT1-2 which equals the temperature loss from the exit area of the CCM device 100 to the entry of the induction heating device 40;
- DT1-3 which equals the temperature loss from the exit area of the CCM device 100 to entry of the fuel heating device 30;
- DT3-2 which equals the temperature loss from the exit of the fuel heating device 30 to the entry of the induction heating device 40.

Based on a given production plant layout; on controlled speeds along the different conveyors and/or the different conveyor sections; on the above defined pre-set duration times t2 and t3; as well as on the tracking by sensor means of the long intermediate products inserted into and traveling along the specific production plant, the mathematical model above introduced is also able to assume estimated times employed by the long intermediate products to displace between different production plant stations.

In particular, the following time can be estimated:

- t1-2 which equals the time from the CCM device exit area 100 to the entry of the induction heating device 40;
- t1-3 which equals the time from CCM device exit area 100 to entry of the fuel heating device 30; and
- t3-2 which equals the time from the exit of the fuel heating device 30 to the entry of the induction heating device 40.

Based on the above actual, sensor-measured values; on the setup values which are pre-set according to the specific production plant layout; and on the above assumed and/or model-derived values, the method according to the present invention can systematically obtain an array of threshold temperature values Tc3, Tc3*, Tc1 which univocally determine the choice to be automatically operated between several possible production work-flow paths or routes route 1, route 2, route 3.

Such threshold values, in function of which a choice is automatically operated between several possible production work-flow paths, will be explained below in connection with the detailed description of the sequence of steps carried out by the method according to the present invention and in connection with the parallel illustration of the corresponding processes of FIG. 3.

Starting from the sensor-aided measurement of the actual temperature T1 at the continuous casting machine exit area 100, or CCM exit area 100, of a given production plant having a defined layout,

- the time t3-2 from the exit of the fuel heating device 30 to the entry of the induction heating device 40 is subsequently model-estimated; as well as
- the temperature losses DT1-3 and DT3-2 are thermal model-derived.

As mentioned, the available pre-set temperature increase DT2 in the induction heating device 40 and the pre-set temperature increase DT3 in the fuel heating device 30 are known for a specific production plant with a given layout and a planned usage thereof.

Based on the assumption of a specific production plant with a given layout and a planned usage thereof as above indicated, a target temperature TC4, which is to be construed as an expected and wished-for temperature at the entry of the rolling mill 200, is input in the mathematical model. Target temperature TC4 is such that the processing of the long intermediate products through the rolling mill 200 can be optimally carried out, in consideration of rolled product quality and of manufacturability. TC4 is therefore preferably linked to and dictated by the predefined technical choices on the final, processed product resulting from the rolling process out of the rolling mill 200. Ideally, measured T4 and TC4 converge to a same value.

By way of virtual sensors introduced for simulation in the model of the given production plant, target temperature TC4 is routinely confronted with the actual temperature T4 sensor-measured on the physical production plant, so that the mathematical model takes such information into account, in a way that the simulation of production operations by the mathematical method adaptively follows and updates with the actual situation on the physical production plant.

Based on the above input data, a first threshold temperature Tc3 is calculated.

Figure 3:
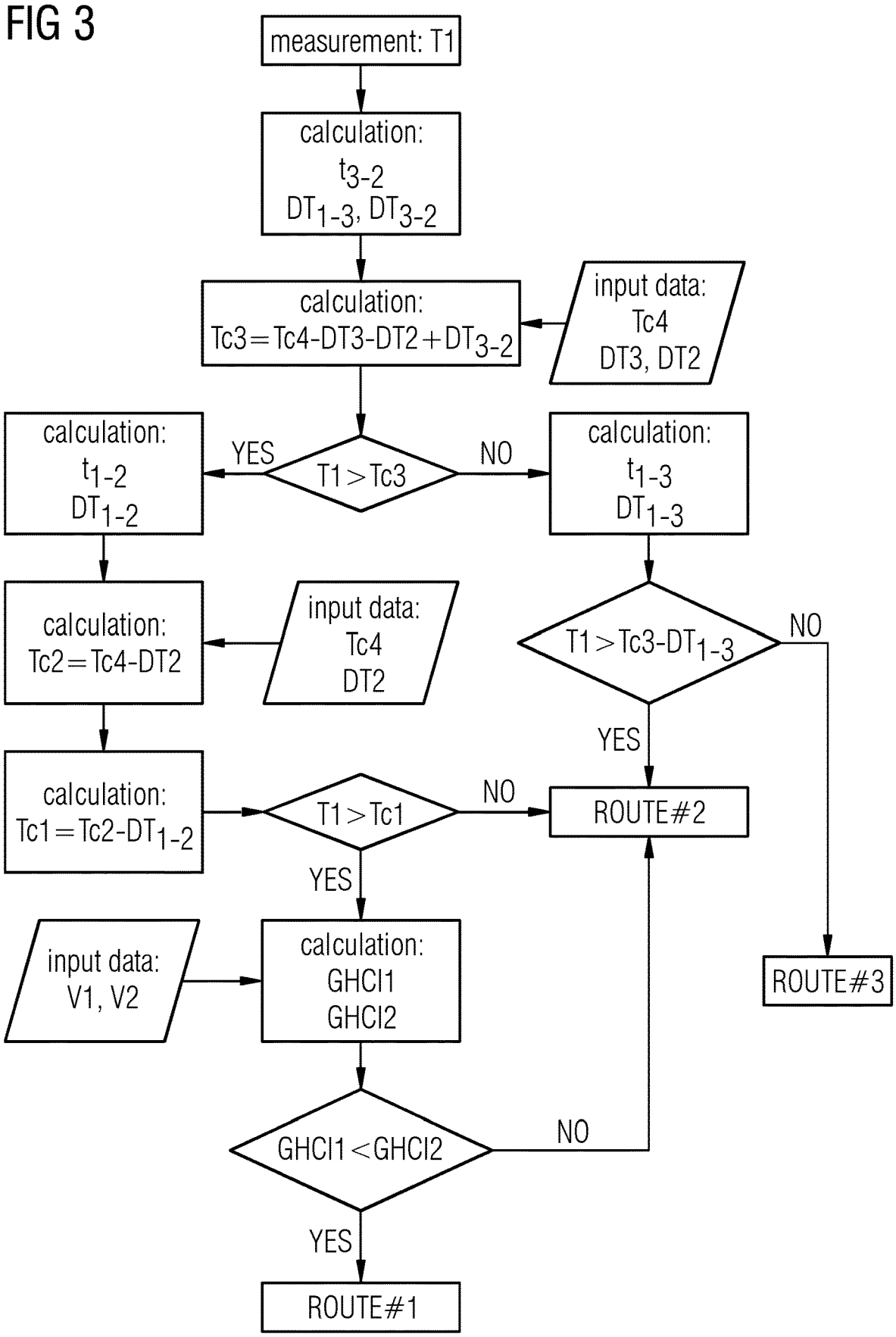
FIG. 3 shows a schematic representation of the work-flow according to a preferred embodiment of the method of production optimization of the present invention, specifying the steps which an algorithm underlying the present invention implements

As shown in FIG. 3, Tc3 is determined as the difference between target temperature TC4 and the sum of

- the pre-set temperature increase DT2 in the induction heating device 40; and
- the pre-set temperature increase DT3 in the fuel heating device 30;

while also taking into account and compensating for the thermal-model derived temperature loss DT3-2 from the exit of the fuel heating device 30 to the entry of the induction heating device 40. A first threshold temperature Tc3 so defined is substantially a check temperature at the entry of the fuel heating device 30, establishing process feasibility.

If the measured temperature T1 is higher than the first threshold temperature Tc3, then the method according to the present invention automatically determines that it is an option, from a feasibility and economical point of view, to process the long intermediate products according a so-called production route 1, or production path 1, that is to keep on transferring the long intermediate products delivered at the continuous casting machine exit area 100 to the induction heating device 40 via conveyors w1 and then on to the rolling mill 200 via conveyors w2.

If the measured temperature T1 is lower than the first threshold temperature Tc3, then the method according to the present invention automatically determines, already at this stage, that it is not an option, from a feasibility and economical point of view, to process the long intermediate products according a so-called production route 1, or production path 1. Rather, the method according to the present invention automatically determines that the only remaining options, in order to minimize the global heating index cost for the current intermediate products and the given production plant, are either following a so-called production route 2, or production path 2; or following a so-called production route 3, or production path 3.

In the production route 2, long intermediate products arrived at the continuous casting machine exit area 100 are transferred by transfer means tr2 to the hot buffer 50. After that, such intermediate products are brought by conveyor means w3 to fuel heating device 30 and, via transfer means tr3, they are displaced on conveyor means w1 towards the induction furnace 40. Eventually, such intermediate products are forwarded via conveyor section w2 to the rolling mill 200.

In the production route 3, long intermediate products arrived at the continuous casting machine exit area 100 are preliminarily transferred by transfer means tr2 to the hot buffer 50. After that, such intermediate products are further transferred, by the same transfer means tr2 or by similar transfer means extending the displacement range thereof, to the cold buffer 60 where they are stocked. A functional and/or physical connection (exemplified in FIG. 1 by a dotted line) may be established between the cold buffer 60 and the cold charging table 70, in a way that intermediate products cold stored for longer time in some warehouse or similar can later be reintroduced in the production workflow, via a passage through the fuel heating device 30 for temperature equalization, and subsequently transferred via transfer means tr3 to conveyor w1 and induction heating device 40 and eventually forwarded via conveyor section w2 to the rolling mill 200.

In order to automatically discern between said production route 2 and said production route 3, the method according to the present invention calculates a second threshold temperature Tc3*, dependent from the first threshold temperature Tc3 and preferably equivalent to Tc3 minus the temperature loss DT1-3 from the exit area of the CCM device 100 to entry of the fuel heating device 30 which is thermal-model derived in light of the estimated time t1-3 from CCM device exit area 100 to entry of the fuel heating device 30.

If the measured temperature T1 is higher than such second threshold temperature Tc3*, then the current intermediate product is directed to follow production route 2.

If instead the measured temperature T1 is lower than such second threshold temperature Tc3*, then the current intermediate product is directed to follow production route 3.

If the measured temperature T1 is higher than the first threshold temperature Tc3 and the production route 1 remains an option, the method according to the present invention, given that the current long intermediate product is hot enough at the CCM device exit area 100 to make it convenient to avoid the cold buffer 60, automatically determines whether the current long intermediate is to be directed along the production route 1 or along the production route 2, in order to keep the Global Heating Cost Index to a minimum.

In order to automatically determine whether the current long intermediate is to be directed along the production route 1 or along the production route 2, the method according to the present invention refers to a third threshold temperature Tc1, which substantially represents a further check temperature at the continuous casting machine exit area 100.

The calculation of the third threshold temperature Tc1 is based on the above introduced mathematical model which is updated with the input of the following data:

- the current target temperature TC4;
- the pre-set temperature increase DT2 in the induction heating device 40; and
- the temperature loss DT1-2 from the exit area of the CCM device 100 to the entry of the induction heating device 40 which is thermal-model derived in light of the estimated time t1-2 elapsing from the CCM device exit area 100 to the entry of the induction heating device 40.

Based on the above input data, in a first step the intermediate temperature Tc2, representing a reconstructed check temperature at the entry of the induction heating device 40, is calculated as a difference between the actualized Tc4 and DT2.

In a second step the third threshold temperature Tc1 is calculated as a difference between Tc2 and DT1-2.

If the measured temperature T1 is lower than such third threshold temperature Tc1, then the current intermediate product is directed to follow production route 2.

If instead the measured temperature T1 is higher than such third threshold temperature Tc1, then the method according to the present invention automatically operates a further check.

Based on the current input data collected by way of sensors at stations V1 and V2 at the time when each long intermediate product is detected and passes through said stations V1 and V2; and based on the consequent calculation by way of the mathematical model of the Global Heating Cost Index implied by the current long intermediate product in case it followed the production route 1 or instead in case it followed the production route 2, the method according to the prevent invention automatically determines:

- that the current long intermediate product be directed to production route 1 if the global heating index cost GHCI1 associated with route 1 under the given conditions is less than the global heating index cost GHCI2 associated with route 2; or, else,
- that the current long intermediate product be directed to production route 2 if the global heating index cost GHCI1 associated with route 1 under the given conditions is more than the global heating index cost GHCI2 associated with route 2.

The method and the system according to the present invention effectively rationalize the production of long metal products such as bars, rods, wire and the like, out of processing long intermediate products such as billets, blooms or the like, and effectively obtain to make such production more energy efficient. In fact, thanks to the constant update of the system with current data detected from the sensors on the actual production plant and the parallel updating of the mathematical model via counterpart virtual sensors, the simulation of production operations by the mathematical method adaptively mirrors the actual situation on the physical production plant. Thus, even the fact that energy costs fluctuate throughout the day and change from timeframe to timeframe is correctly taken into account of by the present method.

Thanks to the software-implemented method according to the present invention the seamless entry sequence in the production plant stations downstream of the continuous casting machine is guaranteed. Moreover, particularly the production paths of the processed long intermediate products are optimized, in compliance with a strategy of impact reduction of the manufacturing operations and of eco-efficiency by carbon dioxide emission abatement.

The cost of complying with environmental legislation can thus be significantly reduced by producing according to the present method; moreover, the processed products' quality is enhanced by the automatic routing of the long intermediate products to production routes which are deterministically designated for each of the currently processed products.

The automation control system above introduced can be connected to the processor of a computer system. Therefore, the present application also relates to a data processing system, corresponding to the explained method, comprising a processor configured to instruct and/or perform the steps of the method disclosed herein.

Analogously, the present application also relates to a production plant especially configured to implement the method herein, as previously described herein in its components.

The invention claimed is:

1. A method in a production plant for producing long metal products from a plurality of long intermediate products received from a continuous casting machine exit area, the method comprising:

receiving the plurality of long intermediate products traveling on respective continuous casting lines for carrying the long intermediate products to an exit area of the continuous casting machine;

introducing the long intermediate products from the exit area of the continuous casting machine into a production plant having known layout parameters, wherein the production plant comprises a rolling mill for rolling the long intermediate products;

a plurality of interconnected production lines extending between the exit area of the continuous casting machine and the rolling mill, wherein each production line defines one path of a production path; and a plurality of heating devices comprising at least a first and a second heating device;

applying a mathematical model to simulate functioning of the production plant, including the plurality of heating devices, so as to calculate dynamically reference value representing a Global Heating Cost Index for the production plant;

determining for each of the long intermediate products a respective minimizing path of the production paths that minimizes the reference value; and automatically routing each of the long intermediate products along the respective minimizing path which minimizes the reference value.

2. A method according to claim 1, wherein dynamically calculating the reference value, comprises:

at a station of the production plant adjacent to the exit area of the continuous casting machine, measuring temperature of each long intermediate product;

determining adaptively a plurality of threshold temperatures;

iteratively comparing the temperature of each of the long intermediate products measured at the station with the threshold temperatures to automatically determine which production path or route is to be followed by each of the long intermediate products for minimizing the reference value, for each of the long intermediate products.

3. The method according to claim 2, wherein the threshold temperatures are based on at least one of pre-set data comprising known performances of the heating devices, known layout parameters of the production plant, modelled physical properties of the long intermediate products and predefined technical target properties of the final, processed product resulting from the rolling process out of the rolling mill.

4. The method according to claim 1, further comprising basing the dynamic calculating of the reference value, on real-time input-data relating to the long intermediate products and the processing thereof within the production plant, and detecting input-data by sensors at corresponding stations of the production plant.

5. The method according to claim 4, wherein the stations of the production plant at which real-time input-data relating to the long intermediate products and the processing thereof are detected comprise:

a first station adjacent to the continuous casting machine exit area; and a second station adjacent to the entry to the first heating device.

6. The method according to claim 5, wherein the stations of the production plant at which real-time input-data relating to the long intermediate products and the processing thereof are detected further comprise:

a third station adjacent to the entry to the second heating device; and a fourth station adjacent to the entry to the rolling mill.

7. The method according to claim 1, wherein applying a mathematical model to the production plant for dynamically calculating the reference value, comprises:

establishing a direct link between the layout of the production plant and the mathematical model used for the simulation thereof, by providing a plurality of virtual sensors defined in the mathematical model which reflect or are linked with sensors of the production plant, so that the simulation of production operations by the mathematical model adaptively mirrors the production operations carried out by the production plant.

8. The method according to claim 1, further comprising:

automatically activating transfer devices of the long intermediate products on the production plant; and transferring the long intermediate products by the transfer devices along the plurality of production paths so that, as a result of dynamically calculating the reference value, each of the long intermediate products follows the production path that minimizes the reference value.

9. The method according to claim 8, wherein the long intermediate products are transferred between the continuous casting machine exit area; and either: (1) a first production line of the production plant along which the long intermediate products are directly conveyed to the rolling mill by a first transfer device of the transfer devices;

or (2) a further production line comprising buffer stations configured to store the long intermediate products, by a second transfer device of the transfer devices.

10. The method according to claim 9, further comprising:

transferring the long intermediate products between opposite production lines by a third transfer device in order to route the long intermediate products from the buffer stations on the further production line to the first production line, so that rolling is subsequently carried out thereon by the rolling mill.

11. The method according to claim 2, further comprising:

when the temperature of each long intermediate product, measured at a station of the production plant adjacent to an exit area of the continuous casting machine, is higher than a first threshold temperature then automatically determining that transfer processing the long intermediate product according to a first production path is an option, wherein the transfer processing comprises:

transferring the long intermediate product delivered at the continuous casting machine exit area to a first heating device; and subsequently transferring the long intermediate product to rolling mill to be rolled.

12. The method according to claim 2, comprising:

when the temperature of each long intermediate product measured at a station of the production plant adjacent to the exit area of the continuous casting machine is lower than a first threshold temperature of the plurality of threshold temperatures, automatically determining that transfer processing the long intermediate products according to the first production path is an option; and calculating a second threshold temperature.

13. The method according to claim 12, further comprising:

when the measured temperature at a station of the production plant adjacent to the exit area of the continuous casting machine is higher than the second threshold temperature, directing an intermediate product being processed to follow a second production path, which comprises:

transferring the long intermediate product delivered at the continuous casting machine exit area to a hot buffer station on a further production line;

subsequently, after a storage time, bringing the long intermediate product to a second heating device for temperature equalization;

transferring the long intermediate product from the further production line to a production line of the production plant along which the long intermediate products are directly conveyed to the rolling mill;

taking the long intermediate product to the first heating device; and forwarding the intermediate product to the rolling mill.

14. A method according to claim 12, further comprising:

when the measured temperature at a station of the production plant adjacent to the exit area of the continuous casting machine is lower than the second threshold temperature, directing an intermediate product being processed to follow a third production path, which comprises:

transferring the long intermediate product delivered at the continuous casting machine exit area to a hot buffer station on a further production line;

subsequently, bringing the long intermediate product to a cold buffer station where the long intermediate product remains stocked.

15. The method according to claim 14, further comprising:

reintroducing the long intermediate product stocked on the cold buffer station in the production plant by:

transferring the long intermediate product from the cold buffer station to a cold charging table;

subsequently transferring the long intermediate product from the cold charging table to the second heating device for temperature equalization;

transferring the long intermediate product from the further production line to a production line of the production plant along which the long intermediate products are directly conveyed to the rolling mill;

displacing the long intermediate product towards the first heating device; and forwarding the long intermediate product to the rolling mill.

* * * * *